United States Patent [19]

Culling

[11] 4,329,173

[45] May 11, 1982

[54] ALLOY RESISTANT TO CORROSION

[75] Inventor: John H. Culling, Kirkwood, Mo.

[73] Assignee: Carondelet Foundry Company, St. Louis, Mo.

[21] Appl. No.: 135,525

[22] Filed: Mar. 31, 1980

[51] Int. Cl.[3] ..... C22C 38/16

[52] U.S. Cl. ..... 75/125; 75/128 A; 75/128 G; 75/128 W

[58] Field of Search ..... 75/125, 128 A, 128 G, 75/128 W

[56] References Cited

U.S. PATENT DOCUMENTS

| | | | |
|---|---|---|---|
| 2,553,330 | 5/1951 | Post et al. | 75/122 |
| 2,633,420 | 3/1953 | Spitz | 75/125 |
| 2,777,766 | 1/1957 | Binder | 75/134 |
| 3,044,871 | 7/1962 | Mott | 75/125 |
| 3,048,485 | 8/1962 | Bieber | 75/128 |
| 3,168,397 | 2/1965 | Scharfstein | 75/128 |
| 3,547,625 | 12/1970 | Bieber et al. | 75/128 |
| 3,758,294 | 9/1973 | Bellot | 75/122 |
| 3,758,296 | 9/1973 | Johnson | 75/122 |
| 3,759,704 | 9/1973 | Culling | 75/122 |
| 3,813,239 | 5/1974 | Flint | 75/122 |
| 3,856,516 | 12/1974 | English | 75/128 W |
| 3,947,266 | 3/1976 | Culling | 75/122 |
| 4,135,919 | 1/1979 | Culling | 75/122 |
| 4,172,716 | 10/1979 | Abo et al. | 75/124 |

FOREIGN PATENT DOCUMENTS 1062658 3/1967 United Kingdom .

OTHER PUBLICATIONS

*A Text Book of Metallography,* Gustav Tamman, The Chemical Catalog Co., Inc., 1925, pp. 312–314.

*Corrosion and Corrosion Control,* Herbert H. Uhlig, John Wiley and Sons, 1963, pp. 258–260.

*Theory of Corrosion and Protection of Metals,* N. D. Tomashov, The MacMillen Co., 1966, pp. 498, 499, 540, 541, 273–276.

*Primary Examiner*—John P. Sheehan

*Attorney, Agent, or Firm*—Senniger, Powers, Leavitt and Roedel

[57] ABSTRACT

An air-meltable, castable, weldable, nonmagnetic alloy resistant to corrosion in sulfuric acid over a wide range of acid strengths. The alloy consists essentially of between about 18 and about 22% by weight nickel, between about 16.8 and 19.2% by weight chromium, between about 0.35 and about 1.95% by weight molybdenum, between about 2.5 and about 3.9% by weight copper, between about 3.2 and about 4.7% by weight manganese, between about 0.35% and 0.80% by weight niobium, up to about 0.7% by weight titanium, up to about 0.4% by weight tantalum, up to about 0.01% by weight boron, up to about 0.5% by weight cobalt, up to about 0.7% by weight silicon, up to about 0.08% by weight carbon, up to about 0.6% by weight of a rare earth component selected from the group consisting of cerium, lanthanum, and misch metal, up to about 0.15% by weight nitrogen, and between about 51% and about 58% by weight iron. The nickel content exceeds the chromium content by about 0.85% to about 5.2% by weight.

7 Claims, No Drawings

ALLOY RESISTANT TO CORROSION

BACKGROUND OF THE INVENTION

This invention relates to the field of corrosion-resistant alloys and more particularly to low strategic metal content, nonmagnetic, workable alloys resistant to both oxidizing and reducing sulfuric acid solutions over a wide range of acid concentrations and temperatures.

It is now well recognized that alloys of the iron-nickel-chromium-molybdenum-copper types, which offer good resistance to both oxidizing and reducing solutions of sulfuric acid, are also quite resistant to rusting and to a wide variety of corrosive media and conditions. Such resistance has, in fact, been demonstrated for alloys of practically no iron content up to alloys of considerable iron content. For example, an alloy known commerically as Illium R, consisting nominally of 68% nickel, 21% chromium, 5% molybdenum, 3% copper, 1% iron and small amounts of other elements has such corrosion resistant properties. Another alloy commerically known as Carpenter 20, consisting of nominally 29% nickel, 20% chromium, 2.5% molybdenum, 3.5% copper, 42% iron, and small amounts of other elements has been very widely and successfully applied in all sorts of corrosive conditions and exhibits relatively good resistance to the various sulfuric acid solutions noted above. There are a number of other alloys ranging in iron content between these two with similar corrosion resistance properties.

I have noted these same characteristics in a number of alloys of my own invention which are of the same type, namely, iron-nickel-chromium-molybdenum-copper base with additions of certain other elements. It is known that such alloys generally tend to be substantially insensitive, to sea water, to salt air, and to industrial atmospheres and a variety of other corrosive atmospheres.

While various stainless steels resist general attack in certain ranges of sulfuric acid concentration and other corrosive media, a majority of them are susceptible to a pitting type attack, crevice corrosion, and stress corrosion cracking failures in chloride media such as sea water or the aqueous fluids often encountered in solar heating systems. Such fluids typically contain 180–1200 ppm $Cl^-$ and 5–400 ppm $Cu^{++}$. It is now well known that additions of the order 0.5 to 3% by weight molybdenum can alter the properites of standard stainless steels in a manner that remarkably increases their resistance to pitting, crevice corrosion, and stress corrosion cracking failures. This has been demonstrated repeatedly for many stainless steels. The most successful stainless steel at present for solar heating applications contains nominally 18% chromium, 2% molybdenum and small amounts of other elements with the remainder consisting of iron. But this alloy is of ferritic crystal structure and therefore strongly magnetic.

For various services, particularly certain military and naval applications, it is highly desirable that construction materials be substantially non-magnetic. Thus, for example, to provide immunity to magnetic detection, it is of critical importance to construct missile-firing submarines from non-magnetic alloys. Fixed site missiles can, of course, be located, and the detection of surface vessel movements is fairly readily achieved by satellite reconnaissance. The chief advantage of the missile-firing submarine is that it is movable and capable of evading detection. Available locating techniques for submarines include sonar, thermal detection systems, sea-bed sensors and magnetic anomaly detection.

Thermal systems are useful only in shallow water. Sea-bed sensors may be evaded. Sonar has already been developed to near the limit of practical possibility. Present sonar transmitters and receivers are powerful enough already to be limited by turbulence and temperature effects in the ocean. However, unless an ordinary steel submarine is very deep and stationary, the presence of so large a mass of moving magnetic metal causes a disturbance in the earth's magnetic field which can be detected by sensitive apparatus. As this equipment is refined, magnetic steel submarines will become more and more vulnerable to attack from airborne missiles or from enemy killer submarines.

Substantially non-magnetic reactor materials such as aluminum, zirconium, titanium and others are well-known, but the greatest metallic mass of the hull, decks, bulkheads and structural parts are generally not fabricated at present from such materials. For example, titanium alloys have remarkable resistance to sea water, but would be virtually impossible to use in hull construction at anything but enormous cost, if at all. Integrity of welds in so vast a structure as an atomic submarine is not feasible at present.

Austenitic alloys, that is alloys of facecentered-cubic crystal structure, may and generally do posses relatively low magnetic permeabilities of the order of 1.2 gauss/oersted or less, as compared to maximum permeabilities for various iron materials ranging from about 100 to 15,000. Ferritic alloys generally exhibit relatively high permeabilities. While alloys of magnetic permeabilities of the order of 1.003 to 1.007 at 200 oersteds can be considered substantially nonmagnetic, permeabilities of abut 1.01 characterize very weakly magnetic materials and are probably still very much below the tolerance levels for use in such applications as the construction of naval vessels such as mine-sweepers or atomic missile-firing submarines.

Lange, Howells, and Bukowski at the U.S. Naval Research Laboratory, as far back as 1958, reported development of various alloys that finally led to employment of alloy steels of about 0.4% carbon, 18% manganese, 4% chromium, and 0.1% nitrogen in actual submarine construction. However, such alloys have proven unsatisfactory due to cracking in service.

A long list of precipitation-hardening stainless steels is now available. These include alloys of good mechanical and fabricating properties but all exhibit substantial magnetism.

Most standard grades of wrought stainless steels develop permeabilities up to 5, 10, even 20 gauss/oersted, during rolling or cold working as the result of structural instability leading to the formation of ferrite, the amounts of which depend upon the grade of stainless and the degree of cold working. Even where not forged or wrought, standard grades of cast stainless steels may display considerable magnetism due to the presence of amounts of ferrite or carbides and nitrides or other compounds in their structure.

Post and Eberly reported in the transactions of the American Society for Metals of 1947 mathematical relationships between the elements in austenitic stainless steels such that they remained structurally stable and substantially nonmagnetic for alloys containing iron, nickel, chromium, molybdenum, carbon and manganese. Schaeffler in 1948 extended the knowledge to include silicon, niobium, and nitrogen, and subsequent workers have recognized that up to a few percent of copper is mildly austenitizing. Franks, Binder and Thompson extended the limits to include up to about 22% manganese in reports in various publications including the 1954 Transactions of the ASM and U.S. Pat. No. 2,225,440.

Thyssen Rohrenwerke Aktien-gesellschaft revealed in British Pat. No. 1,062,658, alloys containing iron, nickel, chromium, manganese, molybdenum, carbon, silicon, nitrogen and niobium and mathematical relationships between these elements to maintain nonmagnetisability.

In 1924, Gustav Tammann of Germany suggested his rule of eights describing the effects upon corrosion resistance of additions of atomic fractions of $\frac{1}{8}$, 2/8, 4/8, or $\frac{7}{8}$ of a noble or resistant element alloyed with a baser or less noble or non-resistant element in various media. Under this concept, one expects the very poor resistance in a given corrosive medium for lesser or non-resistant elements, but there would be stepwide reductions in corrosive attack when the more noble or more resistant element additions reach amounts corresponding to specific atomic percentages. Gradual increases between these amounts have virtually no effect, but sudden drops in corrosion rates are expected at several if not all of these concentrations.

In practice there are very few alloys of iron and nickel base which contain over about 38% chromium by weight, for higher chromium levels tend to result in severe embrittlement problems. Also, there is generally little if any improvement in resistance to corrosion in most media for additions of chromium above this level. Indeed, there are few conditions in which chromium levels over about 22 to 24% are warranted, though levels up to 27 or 28% by weight are regularly specified because effective chromium is somewhat depleted in the formation of carbides, nitrides, or other compounds and to provide some range of tolerances for production purposes.

At the other end of the chromium range, the atomic fractions of 1/16 or $\frac{1}{8}$ provide only enough passivating protection to be useful in very special or relatively weak corrosive media. About 4 to 6% by weight chromium was once used in cutlery grades to resist the mild action of fruit and other food juices. However, even the 11 to 12% chromium range is not efficacious in most severely corrosive substances. The major drop in corrosive rate in most highly corrosive substances takes place at chromium levels corresponding to the 3/16 or $\frac{1}{4}$ atomic fraction levels of chromium.

In U.S. Pat. Nos. 3,759,704 and 3,893,851 I disclosed alloys of excellent general corrosion resistance but of particularly good resistance to wide ranges of sulfuric acid concentrations and temperatures, with chromium levels of 33 to 42% by weight, or at approximately the 3/8 atomic fraction. Johnson U.S. Pat. No. 3,758,296 also teaches sulfuric acid resistance alloys of this general level of chromium. Later I disclosed alloys for the same service but of the lower chromium levels of 23.3 to 30% by weight in Culling U.S. Pat. No. 3,947,266 and 4,135,919. The latter was actually superior to the former despite its reduced strategic metal content and resultant permissible increase in iron content.

While there are ore deposits for molybdenum in the U.S., this metal is in such demand relative to the supply that it is almost as strategically critical at times as are nickel and chromium, both of which depend almost entirely upon imports. U.S. copper deposits are virtually exhausted so that even this element is often in short supply. Niobium is also an imported metal and metallurgically more desirable than titanium and tantalum. Alloys of U.S. Pat. No. 4,135,919 were actually equal or superior to U.S. Pat. No. 3,947,266 despite effective reductions of about 5% in nickel content, 4% in chromium content, 2% in molybdenum content and smaller amounts of copper and niobium.

There has remained the need to further reduce the proportions of strategic elements in alloys of this type without significant loss in workability and weldability while maintaining excellent corrosion resistance. The list of U.S. and foreign patents disclosing alloys of about 20% or more chromium by weight to handle various sulfuric acid solutions is very long, yet tests disclose many of them to be either quite inferior to my prior inventions, or to contain extremely high proportions of strategic elements, or to suffer severe mechanical limitations such as extreme brittleness, or to have all three railings. Alloys of lower chromium contents have suffered even more drastically in these deficiencies.

SUMMARY OF THE INVENTION

Among the several objects of the present invention, therefore, may be noted the provision of improved alloys resistant to both oxidizing and reducing sulfuric acid solutions; the provision of such alloys which are resistant to sulfuric acid over a wide range of concentrations and temperatures; the provision of such alloys which are resistant to sulfuric acid containing oxidizing contaminants, such as nitric acid; the provision of such alloys which can be cast or wrought; the provision of such alloys which have low hardness and high ductility so that they may be readily rolled, forged, welded, and machined; the provision of such alloys which may be economically formulated with relatively low proportions of strategic metals such as nickel, chromium and molybdenum; the provision of such alloys whose strategic metal content is sufficiently low so that they may be formulated from such relatively low-cost raw materials as scraps, ferro alloys or other commerical melting alloys; the provision of such alloys which are substantially nonmagnetic, i.e. for military and naval applications such as submarines and minesweepers; the provision of such alloys that do not require heat treatment after welding to avoid intergranular attack; and the provision of such alloys which resist pitting attack, crevice corrosion and stress corrosion cracking failures.

Briefly, therefore, the present invention is directed to an air-meltable, castable, workable, nonmagnetic alloy resistant to corrosion in sulfuric acid over a wide range of acid strengths. The alloy consists essentially of between about 18 and about 22% by weight nickel, between about 16.8 and 19.2% by weight chromium, between about 0.35 and about 1.95% by weight molybdenum, between about 2.5 and about 3.9% by weight copper, between about 3.2 and about 4.7% by by weight manganese, between about 0.35 and about 0.80% by weight niobium; up to about 0.7% by weight titanium, up to about 0.4% by weight tantalum, up to about 0.01% by weight boron, up to about 0.5% by weight cobalt, up to about 0.7% by weight silicon, up to about 0.08% by weight carbon, up to about 0.6% by weight of a rare earth component selected from the group consisting of cerium, lanthanum, and misch metal, up to about 0.15% by weight nitrogen, and between about 51% and about 58% by weight iron. The nickel content exceeds the chromium content by between about 0.85% and about 5.2% by weight.

Other objects and features will be in part apparent and in part pointed out hereinafter.

DESCRIPTION OF THE PREFERRED EMBODIMENT

In accordance with the present invention, alloys are provided whose proportions of strategic metals are even lower than those of my earlier U.S. Pat. No. 4,135,919. However, despite the low strategic metal content of the alloys of the invention, these alloys are highly resistant to corrosion by sulfuric acid over a wide range of concentrations, both in the reducing and in the oxidizing ranges. These alloys retain their corrosion resistance, even at elevated temperatures, and show effective corrosion resistance in the presence of sulfuric acid concentrations of 20–70%, an environment in which rapid failure is frequently experienced in alloys specifically designed for use in either dilute or concentrated acid. This strong resistance to corrosion is retained moreover, even when the sulfuric acid solution contains oxidizing agents, such as nitric acid.

It has also been found that the alloys of the invention exhibit very low magnetic permeabilities and are thus uniquely suited for various military and naval applications where non-magnetic character is important for purposes of evading detection or otherwise.

The outstanding corrosion resistance of the alloys of the invention is attributable in part to the fact that they are single-phase solid solutions having an austenitic (face-centered cubic) structure. Attainment of this structure does not require heat treatment but is realized in the as-cast condition of the alloy. These alloys not only possess low hardness characteristics as-cast but also remain unaffected by precipitation hardening or structural transformation hardening treatments. Even if the alloy is heat treated under conventional age hardening conditions, no precipitation, phase changes or significant changes in hardness are observed.

The essential components of the alloys of the invention are:

| | |
|---|---|
| Nickel | 18–22% by weight |
| Chromium | 16.8–19.2% |
| Molybdenum | 0.35–1.95% |
| Copper | 2.5–3.9% |
| Manganese | 3.2–4.7% |
| Niobium | 0.35–0.80% |
| Iron | 51–58% |
| Nickel Minus Chromium | 0.85–5.2% |

These alloys are specifically designed to contain nickel, chromium, and molybdenum contents below 23%, 20%, and 2% respectively by weight, the lower limits of present successful commercial alloys for such service, and to contain iron of greater than 50% by weight. Normally, the alloys of the invention will also contain carbon, up to a maximum of about 0.08% by weight.

Optionally, the alloys of the invention may further contain:

| | |
|---|---|
| Titanium | Up to 0.7% |
| Tantalum | Up to 0.4% |
| Boron | Up to 0.01% |
| Cobalt | Up to 0.5% |
| Silicon | Up to 0.7% |
| Cerium, Lanthanum or Misch Metal | Up to 0.6% |
| Nitrogen | Up to 0.15% |

In the field of development of heat-resistant as well as of corrosion-resistant alloys, it has been found that the leaner the alloys in more noble components, the more restricted the allowable ranges of elements generally become for a given application. Stated another way, as alloys come closer to their limits of application, the more carefully their compositional ranges must be controlled. The balance of austenitizing the ferritizing elements must be controlled carefully for corrosion resistance, and the ferritizing elements minimized to limit magnetic permeability. To my knowledge, the alloys of the present invention are the leanest ever devised that still maintain the degree of corrosion resistance and workability shown.

The passivating effect of chromium in oxidizing media is widely recognized. In performing numerous corrosion tests I have noted that the best results over a wide range of sulfuric acid solutions are obtained when the relationship between nickel, chromium and molybdenum are carefully controlled. In the present invention, these elements are balanced to provide a very low chromium content that still results in superior corrosion resistance. Test melts containing 13–14% by weight chromium resulted not only in lowered resistance to oxidizing conditions as expected but also, rather surprisingly, to reducing conditions. Since a chromium level of about 17.5 to 18% minimum is generally required in austenitic stainless steels and of about 17.5% or more in higher alloys, it is noteworthy that alloys of the present invention tolerate slightly lower minimum chromium content without loss of properties. Higher chromium levels than about 19.2% not only result in some loss in corrosion resistance in alloys of this invention, but such alloys also begin to develop magnetism if other ferritizers are all to the high side of the ranges.

The range of chromium composition has also been determined to restrict the range of nickel, which must always be higher than the chromium content by at least about 0.85% but by no more than about 5.2% to maintain the high level of corrosion resistance. A nickel content higher than the chromium content is a characteristic notable in those alloys more resistant to pitting attack, to crevice corrosion and to stress corrosion cracking when the alloys are of the austenitic types. Those austenitic alloys which are essentially standard stainless steels, or such steels modified by other conditions but still containing nickel levels quite a bit lower than chromium levels, are noted for susceptibility to these types of attack in many media, especially those containing halide ions. Especially favorable resistance to corrosion is achieved where the nickel content of the alloys exceeds the chromium content by between about 0.87% and about 4.74%.

Molybdenum is also important for providing resistance to pitting and stress corrosion cracking but, in the alloys of the invention, superior results are achieved at very low levels of molybdenum. For service in halide ion and other highly corrosive environments, it has been found perferable to restrict the ranges of chemical elements to the following ranges:

| | |
|---|---|
| Nickel | 18.66–21.58% |

-continued

| | |
|---|---|
| Chromium | 16.84–19.01% |
| Molybdenum | 0.52–1.93% |
| Copper | 2.51–3.24% |
| Manganese | 3.29–4.54% |
| Niobium | 0.45–0.68% |
| Iron | 51.05–55.14% |
| Nickel Minus Chromium | 0.87–4.74% |

For even better resistance to the widest range of corrosive conditions the components of alloys of this invention should be even further restricted to the following ranges of proportions:

| | |
|---|---|
| Nickel | 18.66–21.58% |
| Chromium | 16.84–18.76% |
| Molybdenum | 0.52–1.93% |
| Copper | 2.82–3.18% |
| Manganese | 3.30–3.70% |
| Niobium | 0.56–0.68% |
| Iron | 51.05–55.13% |
| Nickel Minus Chromium | 1.82–4.11% |

In an especially preferred embodiment of the invention, the nickel content of the alloy exceeds the chromium content by between about 2.18% and about 4.11% by weight with other components in the following ranges of proportions:

| | |
|---|---|
| Nickel | 18.6–21.6% |
| Chromium | 17.20–18.76% |
| Molybdenum | 0.52–1.93% |
| Copper | 2.82–3.17% |
| Manganese | 3.30–3.51% |
| Niobium | 0.56–0.68% |
| Silicon | 0.3–0.5% |
| Carbon | 0.03–0.05% |
| Iron | 51.05–55.13% |
| Nickel Minus Chromium | 2.18–4.11% |

A particularly advantageous alloy having optimum properties in various services has the following composition:

| | |
|---|---|
| Nickel | 21.0 |
| Chromium | 17.5 |
| Molybdenum | 1.2 |
| Copper | 3.1 |
| Manganese | 3.7 |
| Niobium | 0.6 |
| Silicon | 0.3 |
| Carbon | 0.03 |
| Iron | Balance (Approximately 52.8%) |

Manganese, which has been disclosed in approximately the defined range in my prior U.S. Pat. Nos. 3,947,266 and 4,135,919, is useful not only as an austenitizer but also as an aid in corrosion resistance. Additionally, manganese is a deoxidizing element those presence helps ensure the provision of gas-free sound metal ingots. In addition, manganese in the defined range helps maintain non-magnetic properties even after cold rolling or cold forming. However, when chromium content exceeds about 17%, manganese content over about 8% tend to promote magnetism in these alloys during cold working. At about 19% chromium manganese content above about 4.7% tend to do the same. The manganese contents in alloys of this invention are always within the ranges that promote austenite and preferably retard development of magnetism with cold working.

Copper is an essential component of the alloys of the invention in resisting sulfuric acid corrosion but must not exceed about 3.9% or corrosion resistance begins to deteriorate, particularly in pitting type attack.

Molybdenum levels below 2% are notable in the alloys of this invention, particularly since contents of 2% to about 8.5% are specified in most other sulfuric acid resistant alloys. Molybdenum content in the alloys of the present invention may be even slightly lower than in U.S. Pat. No. 4,135,919. At least about 6.35% by weight molybdenum is beneficial in resisting pitting attack, crevice corrosion, and stress corrosion cracking failures in addition to being essential to sulfuric acid resistance. However, if molybdenum exceeds about 1.95% by weight, resistance to various concentration of sulfuric acid and to oxidizing solutions containing sulfuric acid begins to deteriorate. Molybdenum is also a much stronger ferritizer and about seven times stronger than chromium in producing magnetism, particularly under cold working, and must be restricted to the specified range for that reason also.

Niobium is the carbide stabilizer of choice in alloys of this invention to prevent intergranular attack even without heat treatment. It is effective in amounts over about eight times the carbon content, but a niobium content over about 1% by weight has an adverse effect on resistance to pitting in chloride-containing solutions. Niobium is also a very strong ferritizer and is limited in alloys of this invention to maintain nonmagnetic properties.

Tantalum is similar in effect to niobium as a carbide stabilizer but is much costlier, scarcer and about half as effective as niobium on a weight percent basis. The allowable tantalum content of about 0.4% in alloys of this invention permits the use of ferroalloys that contain both niobium and tantalum, but maintains the latter at a sufficiently low level to obviate difficulties in maintaining stable austenite, good workability, and nonmagnetic properties.

Titanium is noted for its beneficial effect on workability in alloys of this type, but it has an adverse effect on resistance to pitting when present above about 0.7%.

Although detrimental if present in excessive amounts, carbon is commonly present as a component which can be tolerated to the extent of about 0.08% by weight. A small amount of carbon may be beneficial in enhancing the fabricability of the alloy. Austenitic steels with low carbon and nitrogen levels are highly resistant to stress corrosion cracking, even though similar proportions of carbon and nitrogen are not beneficial in ferritic stainless steels in that regard. The latter type of alloys are best at about 0.02% carbon as compared to 0.08% permissible in alloys of this invention.

Nitrogen may also be present as an impurity in alloys of this invention prepared by melting in the presence of air. The maximum of about 0.15% by weight is not difficult to maintain with ordinary melting practice, and a small amount is actually beneficial to the ductility and fabricability. Nitrogen is an austenitizing element, but carbides and nitrides are magnetic and should not be present in great amounts. In the absence of titanium, large amounts of nitrogen would also tend to impoverish the metallic matrix in chromium content through formation of chromium nitrides.

Minor proportions of rare earth components such as cerium, lanthanum or misch metal are optionally included in the alloys of the invention. Such proportions may contribute to the fabricability of alloys. The rare earth component should not constitute more than about 0.6% by weight of the alloy. Many of the rare earth metals are very strongly paramagnetic, the gram-atomic susceptibilities being of the order of $1\times10-3$ to $5\times10-3$, but the very small proportions of rare earths permitted in the alloys of this invention have no significant effect on the magnetic properties of the alloys.

Silicon can be tolerated in the alloys of this invention up to about 0.7% by weight without adverse effect on the corrosion resistance. Higher proportions of silicon are undesirable since silicon is a hard, brittle, nonmetallic ferrite-forming element which has a very adverse effect on the hardness, ductility and fabricability of the alloy.

Within the limits specified, born is beneficial for workability and thus may optionally be included. However, when present at amounts significantly in excess of 0.01% by weight, boron has the opposite effect, i.e. embrittling and damaging workability, weldability and machinability.

Cobalt is typically present as an impurity in nickel sources. Accordingly, the alloys of the invention may contain up to about 0.5% by weight cobalt.

Despite their high iron content, the alloys of the invention have low magnetic permeabilities, consistently below 1.003 in magnetizing field strengths from 5 oersteds up to 200 oersteds. Even with cold reductions in thickness of the order of 50%, the permeability remains below 1.006.

While the goals of the work in developing the alloys of this invention were specifically to obtain the desired properties with nickel, chormium and molybdenum contents below the minimum contents of prior commercially successful alloys, no component may deviate significantly from the specified range without major loss in corrosion resistance. General effects of such deviations are noted as follows:

(a) Low chromium and/or high molybdenum contents, depending upon the extent of deviation from the specified ranges, cause moderate or severe losses in resistance in most concentrations of sulfuric acid with our without nitric acid additions at 80° C. or boiling temperatures.

(b) Deleterious effects of low nickel contents are most apparent at higher temperatures of the various corrosive agents, as demonstrated in the boiling solution tests reported hereinbelow, and poor performance generally over 60% $H_2SO_4$.

(c) Excessively high niobium behaves somewhat like chromium in its effect upon general sulfuric acid resistance, while low niobium contents decrease resistance to hot acid solution, especially at boiling temperatures, and in solutions of less than 40% sulfuric acid at 80° C. if absent altogether. Of course, niobium is advantageous in preventing intergranular attack.

(d) Low or high copper contents reduce resistance in concentrated acids and in very hot or boiling solutions.

(e) Low or high manganese contents are particularly bad in boiling solutions, while the latter also damage resistance to concentrations below 50% sulfuric acid at lower temperatures.

(f) While the molybdenum content of the alloys of this invention is quite a bit lower than those of most established or reported sulfuric acid-resistant alloys, the above-defined proportions of molybdenum are extremely important in all concentrations of sulfuric acid except extremely dilute or cold solutions.

(g) If the difference between nickel and chromium content does not fall within the required range, resistance in any of the solutions at temperatures from 80° C. to boiling will suffer. The following examples illustrate the invention.

EXAMPLE 1

One hundred pound heats of several different alloys were prepared in accordance with the invention. Each of the heats was air-melted in a 100-pound high frequency induction furnace. The composition of these alloys is set forth in Table I, with the balance in each instance being essentially iron.

TABLE I

PERCENT BY WEIGHT OF ALLOYING ELEMENTS

| Alloy Number | Ni | Cr | Mo | Cu | Mn | Si | C | Nb |
|---|---|---|---|---|---|---|---|---|
| 1253 | 19.18 | 18.31 | 1.24 | 3.17 | 4.54 | 0.68 | 0.05 | 0.59 |
| 1260 | 18.66 | 16.84 | 1.81 | 3.18 | 3.47 | 0.44 | 0.04 | 0.61 |
| 1262 | 18.85 | 17.41 | 0.53 | 3.24 | 3.97 | 0.55 | 0.05 | 0.57 |
| 1263 | 21.58 | 17.47 | 0.52 | 3.17 | 3.51 | 0.31 | 0.07 | 0.56 |
| 1264 | 19.91 | 19.01 | 1.86 | 3.00 | 3.64 | 0.46 | 0.03 | 0.62 |
| 1265 | 18.74 | 17.25 | 1.78 | 3.16 | 3.29 | 0.23 | 0.06 | 0.53 |
| 1266 | 21.24 | 18.76 | 1.93 | 2.82 | 3.30 | 0.44 | 0.04 | 0.60 |
| 1269 | 21.15 | 17.61 | 1.82 | 2.51 | 4.07 | 0.57 | 0.07 | 0.64 |
| 1271 | 21.07 | 18.32 | 1.35 | 3.11 | 3.31 | 0.26 | 0.05 | 0.68 |

Standard physical test blocks and corrosion test bars were prepared from each heat. Using the as cast non-heat-treated physical test blocks, the mechanical properties of each of these alloys were then measured. The results of these measurements are set forth in Table II.

TABLE II

PHYSICAL PROPERTIES OF ALLOYS AS CAST

| Alloy Number | Tensile Strength P.S.I. | Yield Strength P.S.I. | Tensile Elongation % | Brinell Hardness Number |
|---|---|---|---|---|
| 1253 | 72,510 | 31,340 | 43.5 | 99 |
| 1260 | 75,080 | 34,160 | 40.5 | 144 |
| 1262 | 70,330 | 31,350 | 45.0 | 120 |
| 1263 | 69,550 | 27,670 | 44.5 | 124 |
| 1264 | 74,310 | 34,430 | 46.0 | 142 |
| 1265 | 71,110 | 29,690 | 42.0 | 130 |
| 1266 | 69,060 | 27,740 | 46.5 | 127 |
| 1269 | 61,670 | 24,270 | 43.0 | 121 |
| 1271 | 63,640 | 22,410 | 52.5 | 137 |

Without heat treatment, the corrosion test bars was machined into 1½ inch diameter by ¼ inch thick discs, each having a ⅛ inch diameter hole in the center. Care was exercised during machining to obtain extremely smooth surfaces on the discs. Twelve to 14 discs were obtained for each alloy.

These discs were used in the comparative corrosion tests, described hereinafter, comparing the performance of the alloys of the invention with a number of alloys which either conform to the prior art or which are similar to the alloys of the invention but do not satisfy certain of the critical compositional limitations of the alloys of the invention. The compositions of the comparative alloys used in the tests are set forth in Table III.

TABLE III

| PERCENT BY WEIGHT OF ALLOYING ELEMENTS | | | | | | | | |
|---|---|---|---|---|---|---|---|---|
| Alloy Number | Ni | Cr | Mo | Cu | Mn | Si | C | Nb |
| 1250 | 18.85 | 17.51 | 1.89 | 2.07 | 3.54 | 0.75 | 0.06 | 0.43 |
| 1251 | 18.88 | 16.60 | 2.01 | 4.58 | 0.84 | 0.31 | 0.03 | 0.29 |
| 1252 | 18.04 | 18.26 | 1.48 | 2.81 | 4.35 | 0.56 | 0.05 | 0.59 |
| 1254 | 17.47 | 17.57 | 0.92 | 3.69 | 4.16 | 0.44 | 0.04 | 0.57 |
| 1256 | 18.80 | 17.56 | 5.98 | 3.36 | 4.07 | 0.36 | 0.05 | 0.66 |
| 1257 | 19.42 | 16.34 | 0.61 | 2.94 | 3.85 | 0.31 | 0.08 | 0.38 |
| 1258 | 18.14 | 13.43 | 1.20 | 3.19 | 3.29 | 0.68 | 0.03 | 0.62 |
| 1259 | 20.67 | 16.65 | 2.12 | 2.83 | 3.25 | 0.47 | 0.04 | 0.59 |
| 1261 | 18.39 | 16.72 | 0.66 | 3.10 | 3.55 | 0.36 | 0.06 | 0.55 |
| 1267 | 19.61 | 16.51 | 0.97 | 2.87 | 3.61 | 0.57 | 0.09 | 0.40 |
| 1268 | 18.69 | 14.69 | 1.34 | 3.09 | 3.54 | 0.41 | 0.05 | 0.54 |
| 1270 | 20.14 | 17.50 | 0.92 | 3.10 | 4.12 | 0.33 | 0.08 | NIL |
| 1270C | 20.69 | 16.97 | 0.83 | 3.20 | 4.89 | 0.45 | 0.03 | 0.49 |
| 20 | 29.10 | 20.15 | 2.33 | 3.23 | 0.66 | 0.28 | 0.07 | NIL |
| 20Cb3 | 32.5 | 20.05 | 2.45 | 3.55 | 0.72 | 0.50 | 0.04 | 0.51 |

In the above table, Carpenter 20 conforms to Parson's U.S. Pat. No. 2,185,987 and Carpenter 20Cb3 is a well-known commercial alloy which corresponds to Scharfstein U.S. Pat. No. 3,168,397.

EXAMPLE 2

Using the disc samples of Example 1, corrosion tests were run in 10%, 25% 40%, 50%, 60%, 70%, 93% and 97% by weight sulfuric acid solutions at 80° C. (176° F.).

TABLE IV

| CORROSION RATES IN INCHES OF PENETRATION PER YEAR (I.P.Y.) AT 80° C. IN VARIOUS SULFURIC ACID-WATER SOLUTIONS | | | | | | | | |
|---|---|---|---|---|---|---|---|---|
| ALLOY NUMBER OR NAME | 10% BY WT. $H_2SO_4$ | 25% BY WT. $H_2SO_4$ | 40% BY WT. $H_2SO_4$ | 50% BY WT. $H_2SO_4$ | 60% BY WT. $H_2SO_4$ | 70% BY WT. $H_2SO_4$ | 93% BY WT. $H_2SO_4$ | 97% BY WT. $H_2SO_4$ |
| 1253 | NIL | NIL | 0.0014 | 0.0097 | NIL | NIL | 0.0154 | 0.0084 |
| 1260 | NIL | NIL | 0.0046 | 0.0081 | 0.0062 | 0.0046 | 0.0149 | 0.0059 |
| 1262 | NIL | NIL | NIL | NIL | 0.0086 | 0.0071 | 0.0157 | 0.0081 |
| 1263 | NIL | NIL | NIL | NIL | 0.0054 | 0.0070 | 0.0081 | 0.0054 |
| 1264 | 0.0019 | NIL | NIL | NIL | 0.0049 | 0.0065 | 0.0135 | 0.0095 |
| 1265 | 0.0014 | NIL | NIL | NIL | 0.0049 | 0.0086 | 0.0162 | 0.0054 |
| 1266 | NIL | NIL | 0.0011 | NIL | NIL | 0.0095 | 0.0108 | 0.0041 |
| 1269 | NIL | 0.0008 | 0.0009 | 0.0057 | 0.0076 | 0.0073 | 0.0151 | 0.0089 |
| 1271 | NIL | 0.0054 | 0.0103 | 0.0073 | 0.0084 | NIL | 0.0151 | 0.0049 |
| 1250 | 0.0608 | NIL | 0.0208 | 0.0135 | 0.0119 | 0.0263 | 0.0276 | 0.0186 |
| 1251 | 0.1526 | NIL | 0.0194 | 0.0138 | 0.0146 | 0.0162 | 0.0610 | 0.0475 |
| 1252 | NIL | NIL | NIL | 0.0113 | 0.0097 | 0.0076 | 0.0284 | 0.0111 |
| 1254 | 0.0015 | NIL | NIL | 0.0184 | 0.0119 | 0.2662 | 0.0651 | 0.0113 |
| 1256 | 0.0027 | 0.0626 | 0.0424 | 0.0181 | 0.0108 | 0.0057 | 0.0367 | 0.0130 |
| 1257 | 0.0508 | 0.0178 | 0.0162 | 0.0165 | 0.0165 | 0.0076 | 0.0197 | 0.0100 |
| 1258 | 0.0437 | 0.0157 | 0.0146 | 0.0103 | 0.0062 | 0.0059 | 0.0200 | 0.0119 |
| 1259 | NIL | NIL | 0.0095 | 0.0116 | 0.0016 | 0.0086 | 0.0240 | 0.0057 |
| 1261 | NIL | NIL | 0.0097 | 0.0162 | 0.0057 | 0.7187 | 0.0092 | 0.0059 |
| 1267 | NIL | 0.0024 | 0.0057 | 0.0078 | 0.0089 | NIL | 0.0432 | 0.0081 |
| 1268 | 0.0602 | 0.0008 | 0.0016 | 0.0038 | 0.0035 | NIL | 0.0219 | 0.0122 |
| 1270 | 0.0128 | 0.0205 | 0.0170 | 0.0078 | 0.0068 | 0.0049 | 0.0138 | 0.0081 |
| 1270C | 0.0262 | 0.0159 | 0.0257 | 0.0078 | 0.0100 | 0.0016 | 0.0186 | 0.0119 |
| Alloy 20 | 0.0045 | 0.0102 | 0.0162 | 0.0174 | 0.0181 | 0.0370 | 0.0230 | 0.0210 |
| 20cb3 | 0.0041 | 0.0102 | 0.0091 | 0.0083 | 0.0102 | 0.0512 | 0.0202 | 0.0173 |

In carrying out these tests, each of the discs was cleaned with a small amount of carbon tetrachloride to remove residual machining oil and dirt and the discs were then rinsed in water and dried. Each clean, dry disc was weighed to the nearest 10,000th of a gram and then suspended in a beaker by a piece of thin platinum wire hooked through the center hole of the disc and attached to a glass rod which rested on top of the beaker. Sufficient sulfuric acid solution was then added to the beaker so that the entire sample was immersed. The temperature of the acid was thermostatically controlled at 80° C. by means of a water bath and each beaker was covered with a watch glass to minimize evaporation.

After precisely 6 hours, the sample discs were removed from the sulfuric acid solution and cleaned of corrosion products. Most samples were cleaned sufficiently with a small nylon bristle brush and tap water. Those samples on which the corrosion products were too heavy for removal with a nylon brush were cleaned with a 1:1 solution of hydrochloric acid and water. After the corrosion products had been removed, each disc was again weighted to the nearest 10,000th of a gram. The corrosion rate of each disc, in inches per year, was calculated by the following formula in accordance with ASTM specifications G1-67.

$$R_{ipy} = 0.3937 \frac{W_o - W_f}{ATD}$$

where $R_{ipy}$=corrosion rate in inches per year $W_o$=original weight of sample $W_f$=final weight of sample A=area of sample in square centimeters T=duration of test in years D=density of alloy in g/cc Results of these corrosion tests are set forth in Table IV.

EXAMPLE 3

Since oxidizing contaminants are often present in commercial sulfuric acid streams, the alloys of this invention were tested against the non-conforming alloys for resistance to corrosion in such environments. Using the method described in Example 2, comparative corrosion tests were conducted in 10%, 25%, 40%, and 50% sulfuric acid solutions, each containing 5% nitric acid at 80° C. The results of these tests are set forth in Table V.

TABLE V

CORROSION RATES IN INCHES PER YEAR (I.P.Y.) PENETRATION AT 80° C. FOR VARIOUS SULFURIC ACID-WATER SOLUTIONS PLUS 5% NITRIC ACID

| ALLOY NUMBER | SULFURIC ACID STRENGTH (% BY WEIGHT $H_2SO_4$) 10% | 25% | 40% | 50% |
|---|---|---|---|---|
| 1253 | 0.0054 | NIL | 0.0027 | 0.0054 |
| 1260 | 0.0019 | 0.0016 | 0.0014 | 0.0084 |
| 1262 | 0.0043 | NIL | NIL | 0.0054 |
| 1263 | 0.0016 | NIL | NIL | 0.0022 |
| 1264 | 0.0068 | NIL | NIL | 0.0008 |
| 1265 | 0.0049 | NIL | 0.0008 | 0.0059 |
| 1266 | 0.0014 | 0.0019 | 0.0022 | 0.0068 |
| 1269 | 0.0035 | NIL | NIL | 0.0014 |
| 1271 | 0.0005 | NIL | NIL | NIL |
| 1250 | 0.0049 | NIL | NIL | 0.0088 |
| 1251 | 0.0110 | 0.0005 | 0.0024 | 0.0135 |
| 1252 | 0.0049 | NIL | NIL | 0.0062 |
| 1254 | 0.0143 | 0.0011 | 0.0022 | 0.0113 |
| 1256 | 0.0273 | 0.0157 | 0.0178 | 0.0524 |
| 1257 | 0.0432 | 0.0189 | NIL | NIL |
| 1258 | 0.0049 | NIL | 0.0127 | 0.0275 |
| 1259 | 0.0051 | 0.0014 | NIL | 0.0027 |
| 1261 | 0.0054 | NIL | 0.0014 | 0.0054 |
| 1267 | 0.0054 | NIL | 0.0027 | 0.0081 |
| 1268 | 0.0067 | 0.0035 | 0.0014 | 0.0186 |
| 1270 | 0.0081 | NIL | NIL | 0.0032 |
| 1270C | 0.0335 | 0.0008 | NIL | 0.0027 |

EXAMPLE 4

Using the method described in Example 2, comparative corrosion tests were conducted in boiling 10%, 25%, and 40% sulfuric acid-water solutions, and in boiling 10% and 25% sulfuric acid-water solutions, the last two containing 5% nitric acid. Results of these tests are set forth in Table VI.

TABLE VI

CORROSION RATES IN INCHES PER YEAR (I.P.Y.) PENETRATION FOR VARIOUS BOILING SOLUTIONS OF SULFURIC ACID AND WATER

| ALLOY NUMBER | ACID STRENGTH (% BY WEIGHT) 10% | 25% | 40% | SULFURIC ACID STRENGTH (% BY WEIGHT) PLUS 5% NITRIC ACID 10% | 25% |
|---|---|---|---|---|---|
| 1253 | 0.0375 | 0.0400 | 0.0443 | 0.0076 | 0.0054 |
| 1260 | 0.0435 | 0.0510 | 0.0437 | 0.0068 | 0.0016 |
| 1262 | 0.0292 | 0.0327 | 0.0440 | 0.0068 | 0.0097 |
| 1263 | 0.0311 | 0.0297 | 0.0355 | 0.0062 | 0.0095 |
| 1264 | 0.0230 | 0.0394 | 0.0459 | 0.0065 | 0.0138 |
| 1265 | 0.0216 | 0.0370 | 0.0440 | 0.0054 | 0.0165 |
| 1266 | 0.0373 | 0.0270 | 0.0440 | 0.0041 | 0.0095 |
| 1269 | 0.0294 | 0.0329 | 0.0581 | 0.0011 | 0.0014 |
| 1271 | 0.0324 | 0.0340 | 0.0351 | 0.0054 | NIL |
| 1250 | 0.0600 | 0.1377 | 0.1283 | 0.0049 | 0.0046 |
| 1251 | 0.1526 | 0.1337 | 0.2471 | 0.0150 | 0.0010 |
| 1252 | 0.0302 | 0.0635 | 0.0713 | 0.0038 | 0.0046 |
| 1254 | 0.0867 | 0.0905 | 0.1688 | 0.0127 | 0.0386 |
| 1256 | 0.0794 | 0.1823 | 0.1111 | 0.0378 | 0.2792 |
| 1257 | 0.0780 | 0.0694 | 0.2346 | 0.0732 | 0.0351 |
| 1258 | 0.0570 | 0.0373 | 0.0853 | 0.0049 | 0.0370 |
| 1259 | 0.0894 | 0.0359 | 0.0502 | 0.0051 | 0.0821 |
| 1261 | 0.1229 | 0.0832 | 0.0815 | 0.0032 | 0.0068 |
| 1267 | 0.0578 | 0.0489 | 0.0548 | 0.0022 | 0.0157 |
| 1268 | 0.0451 | 0.0381 | 0.0356 | 0.0086 | 0.0157 |
| 1270 | 0.0694 | 0.0451 | 0.1731 | 0.0113 | 0.0108 |
| 1270C | 0.0613 | 0.0578 | 0.0556 | 0.0443 | 0.0032 |
| Alloy 20 | 0.0370 | 0.510 | 0.0572 | Not Tested | |
| 20cb3 | 0.0160 | 0.0310 | 0.0390 | Not Tested | |

In view of the above, it will be seen that the several objects of the invention are achieved and other advantageous results attained.

As various changes could be made in the above products without departing from the scope of the invention, it is intended that all matter contained in the above description shall be interpreted as illustrative and not in a limiting sense.

What is claimed is:

1. An air-meltable, castable, weldable, nonmagnetic alloy resistant to corrosion in sulfuric acid over a wide range of acid strengths, consisting essentially of between about 18 and about 22% by weight nickel, between about 16.8 and about 19.2% by weight chromium, between about 0.35 and about 1.95% by weight molybdenum, between about 2.5 and about 3.9% by weight copper, between about 3.2 and about 4.7% by weight manganese, between about 0.35 and about 0.80% by weight niobium, up to about 0.7% by weight titanium, up to about 0.4% by weight tantalum, up to about 0.01% by weight boron, up to about 0.5% by weight cobalt, up to about 0.7% by weight silicon, up to about 0.08% by weight carbon, up to about 0.6% by weight of a rare earth component selected from the group consisting of cerium, lanthanum and misch metal, up to about 0.15% by weight nitrogen, and between about 51 and about 58% by weight iron, and wherein the nickel content exceeds the chromium content by between about 0.85 and about 5.2% by weight (basis, the entire alloy).

2. An alloy as set forth in claim 1 wherein the nickel content exceeds the chromium content by between about 0.87 and about 4.74% by weight (basis, the entire alloy).

3. An alloy as set forth in claim 2 wherein the nickel content is between about 18.66% and about 21.58% by weight, the chromium contact is between about 16.84 and about 19.01% by weight, the molybdenum content is between about 0.52 and about 1.93% by weight, the copper content is between about 2.51 and about 3.24% by weight, the manganese content is between about 3.29 and about 4.54% by weight, the niobium content is between about 0.45 and about 0.68% by weight and the iron content is between about 51.05 and about 55.14% by weight.

4. An alloy as set forth in claim 1 wherein the nickel content is between about 18.66 and about 21.58% by weight, the chromium content is between about 16.84 and about 18.76% by weight, the molybdenum content is between about 0.52 and about 1.93% by weight, the copper content is between about 2.82 and about 3.18% by weight, the manganese content is between about 3.30 and about 3.70% by weight, the niobium content is between about 0.56 and about 0.68% by weight, the iron content is between about 51.05 and 55.13% by weight and the nickel content exceeds the chromium content by between about 1.82 and about 4.11% by weight (basis, the entire alloy).

5. An alloy as set forth in claim 1 wherein the nickel content is between about 18.6 and about 21.6% by weight, the chromium content is between about 17.20 and about 18.76% by weight, the molydenum content is between about 0.52 and about 1.93% by weight, the copper content is between about 2.82 and about 3.17% by weight, the manganese content is between about 3.30 and about 3.51% by weight, the niobium content is between about 0.56 and about 0.68% by weight, the silicon content is between about 0.3 and about 0.5% by weight, the carbon content is between about 0.03 and about 0.05% by weight, the iron content is between about 51.05 and about 55.13% by weight, and the nickel content exceeds the chromium content by between about 2.18 and about 4.11% by weight (basis, the entire alloy).

6. An alloy as set forth in claim 1 wherein the carbon content does not exceed approximately one-eighth of the niobium content.

7. An air-meltable, castable, weldable, nonmagnetic alloy resistant to corrosion in sulfuric acid over a wide range of acid strengths, comprising approximately 21.0% by weight nickel, approximately 17.5% by weight chromium, approximately 1.2% by weight molybdenum, approximately 3.1% by weight copper, approximately 3.7% by weight manganese, approximately 0.6% by weight niobium, approximately 0.3% by weight silicon, approximately 0.03% by weight carbon, and the balance essentially iron.

* * * * *

UNITED STATES PATENT AND TRADEMARK OFFICE

CERTIFICATE OF CORRECTION

PATENT NO. : 4,329,173

DATED : May 11, 1982

INVENTOR(S) : John H. Culling

It is certified that error appears in the above—identified patent and that said Letters Patent is hereby corrected as shown below:

Column 1, line 34, "insensitive, to" should read -- insensitive to --. Column 2, line 26, "facecentered" should read -- face-centered --. Column 4, line 21, "railings" should read -- failings --. Column 6, line 13, "the" (second occurrence) should read -- and --. Column 9, line 15, "born" should read -- boron --. Column 10, line 53, "was" should read -- were --. Column 13, line 64, "0.510" should read -- 0.0510 --. Column 14, claim 3, line 34, "contact" should read -- content --.

Signed and Sealed this

*Twenty-third* Day of *November 1982*

[SEAL]

*Attest:*

GERALD J. MOSSINGHOFF

*Attesting Officer* *Commissioner of Patents and Trademarks*